US005197617A

United States Patent [19]

Edwards

[11] Patent Number: 5,197,617

[45] Date of Patent: Mar. 30, 1993

[54] LOCKABLE CLOSURE FASTENING AND TAMPER EVIDENT CLOSURE

[75] Inventor: Cyril K. Edwards, Oadby, United Kingdom

[73] Assignee: Ariel Industries plc, Leicester, United Kingdom

[21] Appl. No.: 595,866

[22] Filed: Oct. 12, 1990

[30] Foreign Application Priority Data

Oct. 13, 1989 [GB] United Kingdom ..... 8923118
Jul. 3, 1990 [GB] United Kingdom ..... 9014752

[51] Int. Cl.[5] ..... B65D 55/02; B65D 41/34

[52] U.S. Cl. ..... 215/221; 215/256; 215/251; 215/254; 215/274

[58] Field of Search ..... 215/256, 251, 252, 254, 215/204, 216, 221, 274, 276, 281, 317, 217, 219, 250, 253, 330, 331, 334

[56] References Cited

U.S. PATENT DOCUMENTS

| | | | |
|---|---|---|---|
| 2,226,390 | 12/1940 | Rosevear, Jr. | 215/217 X |
| 2,326,480 | 8/1943 | Merolle | 215/256 |
| 3,399,796 | 9/1968 | Steiner | 215/216 |
| 3,445,022 | 5/1969 | Cilluffo | 215/216 |
| 3,482,723 | 12/1969 | Esposito, Jr. | 215/221 |
| 3,695,476 | 10/1972 | Ruekberg | 215/216 |
| 3,741,421 | 6/1973 | Wittwer | 215/216 X |
| 3,746,199 | 7/1973 | Hart et al. | 215/256 |
| 3,820,678 | 6/1974 | Zipper et al. | 215/274 X |
| 3,828,958 | 8/1974 | Shannon | 215/221 |
| 3,895,731 | 7/1975 | Coursaut | 215/218 |
| 3,901,400 | 8/1975 | Westfall | 215/221 |
| 3,913,769 | 10/1975 | Scrocco et al. | 215/206 |
| 4,071,156 | 1/1978 | Lowe | 215/224 |
| 4,560,016 | 12/1985 | Boik | 215/252 |
| 4,576,298 | 3/1986 | Boik | 215/252 |
| 4,645,087 | 2/1987 | Kusz | 215/254 |
| 4,679,696 | 7/1987 | Bonnenfant et al. | 215/252 |
| 4,746,026 | 5/1988 | Leonhardt | 215/252 |
| 4,801,032 | 1/1989 | Crisci | 215/256 |
| 4,886,175 | 12/1989 | Schlaudecker | 215/251 X |
| 4,919,286 | 4/1990 | Agbay, Sr. | 215/235 |

*Primary Examiner*—Stephen Marcus
*Assistant Examiner*—Vanessa Caretto
*Attorney, Agent, or Firm*—Lackenbach Siegel Marzullo Aronson & Greenspan

[57] ABSTRACT

A closure (30) for an aperture (70) with a co-operative peripheral rim profile, such as the mouth of a container, the closure incorporating a self-locking fastener element (40) which cooperates with the rim profile and locks the closure on to the aperture upon limiting engagement thereof.

10 Claims, 4 Drawing Sheets

LOCKABLE CLOSURE FASTENING AND TAMPER EVIDENT CLOSURE

BACKGROUND OF THE INVENTION

1. Field of the Invention

This invention relates to lockable closure fastenings for apertures, especially the access mouths of containers or other enclosures.

2. Description of the Prior Art

The term 'closure' employed herein embraces any form of cover, cap or lid, spanning and at least partially closing the spatial extent of an aperture.

Some means is usually provided for locating and securing or fastening the closure in place upon the aperture.

Thus closures commonly employ a threaded fastening for fitting to a container, with complementary threads on the closure and a peripheral rim profile, typically upon an upstanding neck, of the container mouth or aperture.

In such threaded closure fastenings one aspect of the invention is particularly concerned with a closure fastener thread-locking device.

This effectively also becomes a fastener-locking element—and in particular a self-locking (threaded) closure fastening.

The term 'thread' employed herein embraces any form of cooperative, interactive mating or interlocking arrangement, whether of multiple complementary members or otherwise.

In the threaded fastener art generally, when a plurality of members are threaded together, it is advantageous in some uses to provide a means for 'locking' or jamming the threads and thereby inhibiting further relative movement of these threaded members—in either an unlocking (and unfastening) or a locking (and fastening) direction.

Moreover, if such a thread-locking element is automatically effected after a certain relative thread travel, a more secure thread fastening and thus convenient overall installation is achieved.

It is known to employ an intermediate resiliently deformable (temporary) binding agent for such a locking purpose—for example a synthetic plastics material bonding to a metal thread.

Once locked, unlocking generally either requires excess physical force to 'over-ride' the mechanical lock, typically breaking or rupturing the locking material, or severing and prising or tearing away the locking material from the thread body.

Other aspects of the invention are concerned with the integration of a closure locking device with a seal.

The term 'seal' employed herein embraces any form of mechanically close, tight or interference fit, relative disposition of elements, whether a fluid (i.e. gas or liquid)-tight, or hermetic seal, or otherwise.

Alternatively, the seal may be operative only in a 'security' sense—i.e. as an element that must be deliberately and visibly broken to gain admission to the contents of an article sealed thereby.

Thus, in some instances, the elements for, and associated implementation of, closing, fastening, locking and sealing may be integrated 'seamlessly'.

Container closures commonly provide some form of seal, in order to secure the container contents, and inhibit the egress (i.e. leakage or spillage) of contents from the container—or indeed the ingress of contaminants into the container.

Such sealing has hitherto commonly relied upon an internal resilient annular washer incorporated in the base of a closure cap, and compressed by contact with the upper rim of a container neck once the cap is securely fastened in place.

This very compression at the last stage of fastening may act as a fastening lock, particularly when vacuum or relatively low internal container pressures are imposed.

The resilience, (and in particular the characteristic 'spring click' noise exhibited when depressed and released) of such caps under a sealed container pressure differential has been relied upon in the past as an indicator that the container seal has not been broken. Unfortunately, this differential pressure and associated pressure signal can be re-created by miscreant interference—and so is not a reliable guide.

Sealing may thus represent a critical factor in the container closure—to the extent that some positive indication should be furnished, if the seal has not been positioned, is not yet completely effective, or less been subsequently displaced or otherwise interfered with.

Hence the convenient and apposite nomenclature 'tamper-evident closure' is used for such locking seals—that is seals which resist tampering, but if overcome, provide a positive indication thereof.

In that regard, the term 'tamper-proof' is less apposite, since a humanly-devised security system inevitably admits of human ingenuity in overcoming the security hurdle presented.

The storage of foodstuffs in containers represents an important use of such tamper evident closures.

In such uses, the aforesaid integration of threaded fastener locking and seal formation—such that a container closure is automatically secured and locked into position on a container as a seal is formed—is particularly advantageous.

With such integration, unlocking (i.e. for subsequent unfastening and opening) of the closure requires breaking of the seal—desirably as a deliberate and, most importantly, self-evident, preliminary step.

In the closure sealing art it is known to employ a peripheral sealing band, typically of synthetic plastics material, temperature shrunk into place after fitment of the closure.

However this form of seal is vulnerable to removal, simply by applying an elevated temperature (for example by immersion in hot water) and reinstatement by reverse cooling—allowing intervening tampering with the contents.

Indeed malicious tampering with container contents, with attendant commercial and consumer health risks, has become more prevalent—making the provision of a tamper-evident (container) closure highly desirable—even virtually essential in such applications as baby food storage, in order to maintain consumer confidence in the edibility of the product.

For such applications it will be appreciated that the integrated self-locking fastening and sealing of a container closure is particularly advantageous.

According to one aspect of the invention there is provided a closure for an aperture with a co-operative peripheral or boundary (rim) profile, such as the mouth of a container, the closure incorporating a self-locking fastener (element) which cooperates with the peripheral (rim) profile and securely locks the closure on to the aperture upon limiting engagement thereof.

Desirably, the fastener locking element is integrated with a peripheral security seal, disposed to inhibit unlocking, unfastening and opening of the closure once installed.

While such a seal may be over-ridden or broken, in order to overcome the inhibition upon closure unfastening and opening, the very act of seal breakage provides permanent and vital evidence—even on casual inspection—that the closure has been tampered with.

Randomly generated, matched pairs of easily visible security markings on the seal and closure respectively could be provided in production, after initial closure fastening and seal installation, in order to prevent substitution of another (fresh) seal after the initial container opening.

A multiple 'combination' rotating drum indentation mechanism, applied in rolling contact with the periphery of the container closure, could provide such security marking as a post-production step upon closure fastening.

According to another aspect of the invention there is provided a lockable threaded container closure fastening utilising complementary threads upon the container mouth and closure, with a (thread) locking element disposed to selectively either run aligned therebetween, allowing relative rotation thereof, for fastening and unfastening of the closure, or to become misaligned therewith (for example, axially offset therefrom), to obstruct such rotation.

With such arrangements, although the closure is reusable—i.e. it may be (securely) fastened and unfastened repeatedly—once the initial (integrated) lock and seal has been (visibly) broken by the first act of opening, the automatic or self-locking and sealing element is operative only once.

A container must also be able to withstand vertical stacking loads, such as are encountered in transit and point-of-sale display, without damage to, or reduction in the efficacy of, the individual (internal) closure seal.

For example, if a container lid deforms or buckles at its center, the load on a peripheral rim seal could be eased. Alternatively, if the seal itself bears the load, it may be crushed—to the detriment of the intimacy of its sealing contact with the closure and container.

Some aspects of the present invention provide just this facility, by accommodating and distributing such loads through the threaded fastener locking element—optionally in conjunction with a travel limit and locking abutments on the rim of the container neck.

Although the invention has particular application to the closure, and in particular container closure art, some other aspect admit of a broader use—for example in the (self-locking threaded) fastener art generally.

In that art it is known to employ bonded intermediate thread locking elements of synthetic plastics material, for example Nylon (Trade Mark), as a resiliently deformable bridge between the metal threads of a nut and bolt.

This thread lock may inhibit thread slackening under vibration or may maintain a predetermined locking torque initially applied.

However, such locking elements are re-usable without any visible evidence that the initial lock has been broken—which undermines their original purpose.

Similarly, in the wider container closure art it is known for example to apply, by moulding in situ a plastics closure, with a break-off locking collar, to a metal can with a threaded neck, but this is not suitable for container contents unable to be brought close to the necessary elevated closure-forming temperatures after processing.

Thus, in some of its embodiments, the invention provides a closure for tamper-proofing containers, such as jars, bottles, cans or other enclosures, which have apertures bounded by externally threaded neck-rings, onto which closures with complementary threads can be securely (rotatably) fastened, or 'screwed' to close and seal the apertures.

Such embodiments provide a means of ensuring that, once a container has been closed and sealed by such a closure, it cannot be unsealed and opened—and consequently that the contents cannot be tampered with—without there being visible evidence that the seal has been disturbed, and the closure opened or vulnerable to tampering.

A conventional threaded closure for fastening onto an externally threaded container neck-ring commonly has a top panel and a dependent skirt.

In the case of a metal closure, it is known for the skirt to be rolled inwardly or outwardly at its lower edge, to form a circumferential bead, and either the bead or the skirt is deformed, to enable the closure to engage the threads on a neck-ring, for fastening into sealing engagement with the sealing surface of a neck-ring.

In the case of a plastic closure, the skirt normally terminates in a moulded thread, which likewise engages the threads on a neck-ring, so that the closure can be fastened into sealing engagement therewith.

Unfortunately, such conventional metal or plastic closures can be removed and re-applied without there being any visible evidence that this has been done.

Consequently the fact that a container appears outwardly to be securely sealed with such a conventional closure is no guarantee that the contents have not been tampered with.

SUMMARY OF THE INVENTION

Embodiments of the present invention provide a closure incorporating one or more internal tongues which, as the closure reaches sealing engagement, take up a position where they lock the closure onto the neck-ring, so that it cannot be unfastened without the tongues being removed, and in turn the tongues themselves cannot be removed without an outer ring of the closure being broken—thereby providing visible evidence that the seal may have been disturbed.

The tongues may be moulded integrally with an outer ring, which fits around the outside of a depending closure skirt.

These tongues are marginally spaced inwardly from the outer ring, in order to accommodate the bead depth, and can thereby pass under and inside the skirt—but still outside the container neck ring.

The tongues have thickened (alternatively thread running or thread jamming) portions, which can pass between the threads on a neck-ring when the closure is being applied, but which, when the closure has reached sealing engagement with the container rim, can form a wedge between the closure and the lower ends of the threads, thereby effectively jamming or obstructing those threads and inhibiting the unfastening and opening of the closure.

The wedge action cannot be released, (i.e. the tongues released or displaced from the threads), without the outer-ring being broken.

In turn, the outer-ring is configured so that, once broken, it can be used to pull the tongues from their wedging positions.

The tongues are secured to the closure in a way which inhibits relative angular rotation, but which allows a limited amount of relative axial movement.

The amount of such axial movement required is normally only one-half of a thread pitch, so that the thickened portion can move from a position where it is aligned with a thread groove during installation, to a position where it is directly in line with the body of a thread when installation is completed.

If the tongue is then restrained from moving back into alignment with a groove, it can be caused to lock against the end of a thread, thereby preventing the closure from being unfastened.

In the case of a metal closure, relative angular rotation can be inhibited by locally recessing the rim bead, to form channels (generally aligned with the thread axis) in which the tongues can lie, as they pass in between the closure skirt and the threads of the neck-ring.

Limited relative axial movement can be provided by affording the outer (locking) ring of the closure freedom to move axially relative to the body of the closure.

In the case of a plastic closure, the tongues are conveniently moulded integrally with the outer ring and are afforded sufficient flexibility to permit limited axial movement, within axial retaining slots moulded through the threads on the closure.

There are various ways in which the thickened portion of a tongue can be biassed into a locking position, once it has passed the end of a thread.

Thus, if in passing under and beyond the lower end of a thread, the geometry of the thickened portion or its supporting tongue is changed, by either compression or tension, it will, being an elastic material, have a tendency to revert to its original geometry, once it has passed the end of a thread.

For example, a tongue can be tensioned by restraint from the upper ends of the threads on a neck-ring and offering resistance to any further downward movement of the outer member as it is fastened onto the neck-ring; or it can be brought into compression by the lower end of the tongues coming into contact with a transfer ring or a similar abutment on the neck-ring.

Furthermore, the tail end of the tongue thickened portion can be profiled to lock on to the thread, or can be angled or orientated so that the thread tends to force it upwards between the neck-ring and the closure skirt, when any attempt is made to unfasten the closure.

Similarly, the lower end of a neck ring thread can be angled to act in concert with the profile on the tail end of the thickened portion, to encourage the thickened portion upwards into a locking position.

The locking action can be assisted by positioning an abutment on the neck-ring, which presses the nose of the tongue thickened portion up under the skirt of the closure as the tail end of the thickened portion is passing under the bottom end of the thread.

If a transfer ring (for example, a continuous ring adjacent and below the threads) is present on the neck-ring, it can be positioned to act in this way.

Moreover, if the transfer ring upper surface includes an appropriately placed camming abutment, the pressure exerted on the nose of the thickened portion can be increased to any desired extent.

One important advantage of a closure incorporating internal tongues over a conventional closure is that the tongues can help accommodate any closure top loading. This commonly occurs when sealed containers are stacked on top of each other in storage.

The downward loading on the top on the sealed containers situated at the bottom of a container stack can be considerable and it is important to minimise the load carried by the sealing surfaces.

Thus, as the closure reaches the point of sealing engagement, the tongues passing beneath the bottom edge of the skirt can be brought into contact with a transfer ring, or similar abutment on the neck-ring, and can thereby help inhibit any downward movement of the closure relative to the neck-ring—thereby preventing excess penetration of the neck-ring into the sealing surface of the closure.

BRIEF DESCRIPTION OF THE DRAWINGS

There now follows a description of some particular embodiments of the invention, by way of example only, with reference to the accompanying diagrammatic and schematic drawings, in which.

DESCRIPTION OF THE PREFERRED EMBODIMENTS

Figure 1:
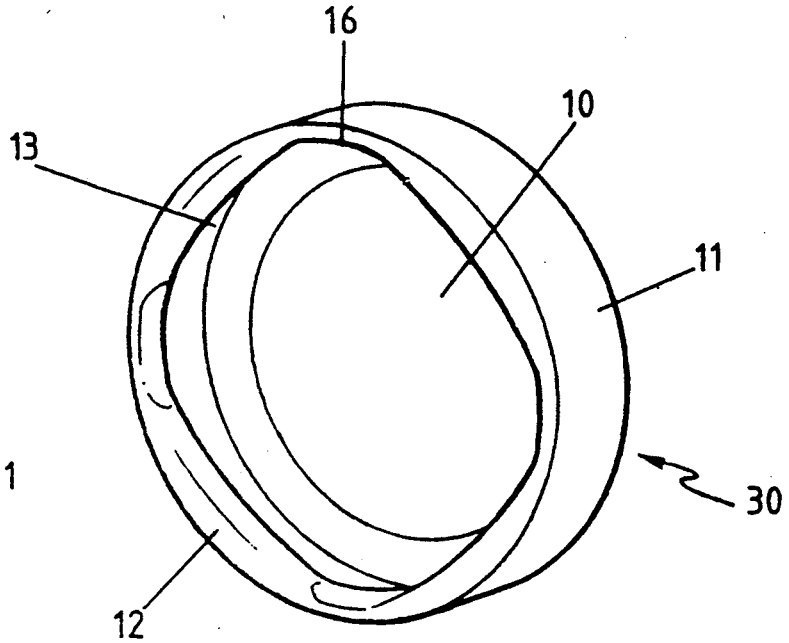
FIG. 1 shows an underside perspective view of a container closure cap incorporating a threaded fastening.

Referring to the drawings, a closure 30 for a container 50, such as a glass jar, with a neck 60 bounding an access aperture 70, comprises a cap with a disc shaped top panel 10 and an outer peripheral dependent skirt 11.

The lower edge of the skirt 11 is turned (for example by rolling) inwardly to form an internal bead, ridge or flange 12, into which are pressed a series of angled (thread-running) grooves 13.

The grooves 13 are of complementary profile to the threads, or more particularly multiple circumferentially-spaced arcuate thread portions, 23 of a neck, or more particularly neck-ring, 60 of a container 50.

Thus, with minor adjustment of relative angular positions of the closure 30 and container 50, the closure thread portions 23 can be aligned with, and thereafter co-operatively engage and pass through, the grooves 13, when the closure 30 is mounted upon the neck-ring 60—to enable progressive (threaded) fastening of the closure 30 upon the container 50.

The cap 30 may be fabricated from a variety of materials, for example pressed metal sheet, painted or plastic-coated, or directly of synthetic plastics material.

In the manner of a conventional closure cap, an internal annular sealing gasket (not shown) may be fitted within the cap 30 for subsequent (compression) sealing engagement with the upper rim or lip of the container neck 60.

Figure 2:
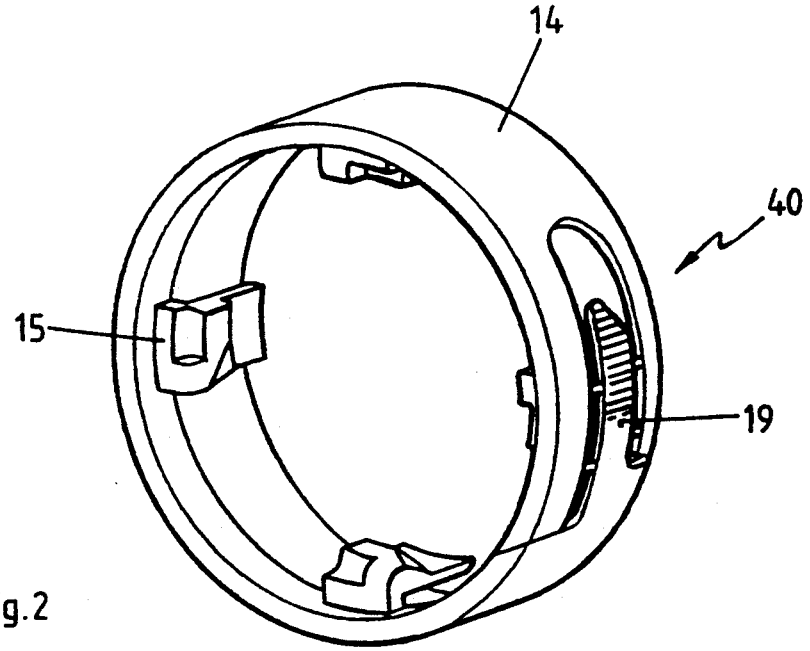
FIG. 2 shows a thread locking ring fastener member for the closure cap of FIG. 1.

A closure (threaded fastener) locking element 40, as shown individually in FIG. 2, in the form of a plastic outer ring member 14, fits around the skirt 11 of the closure and supports a plurality of integrally-moulded, circumferentially-spaced internal locating and thread-running tongues 15.

Each such peripheral tongue 15 corresponds to a successive thread portion 23 on the neck-ring 60 and is radially offset inwardly from the ring 14, enabling it to accommodate the bead 12 depth and pass under the skirt 11 of the closure 30 into corresponding recesses 16 in the threaded bead 12, representing the start of each closure thread portion 23.

A four 'start' thread 23, that is with four successive thread portions, is illustrated, but other multiples may be employed—for example in applications requiring a spread of higher closure tightening loads.

Similarly, the thread angle may be varied to achieve 'fast' or 'slow' thread configurations, which in turn determine the torque loadings and degree of turning required to complete and lock the closure fastening.

Figure 6:
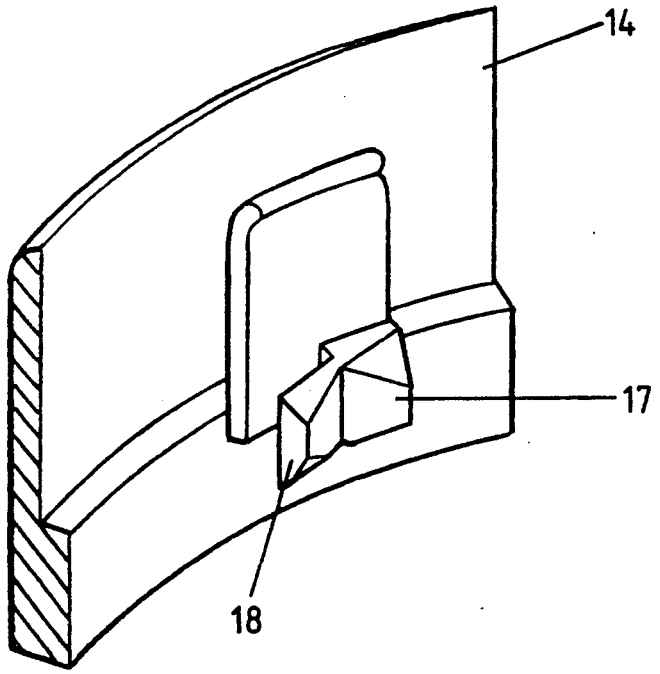
FIG. 6 shows an alternative thread-running and locking tongue configuration to that shown in FIG. 5.
Figure 7:
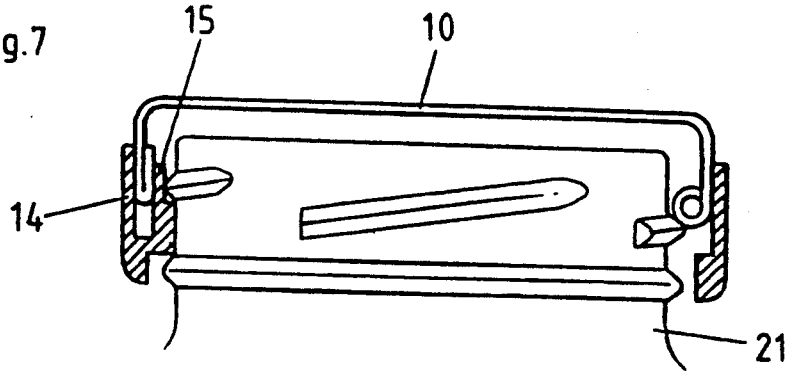
FIG. 7 shows a section of the assembled locking ring and cap of FIG. 3 mounted upon the container neck ring of FIG. 4.

Each tongue 15 carries a thickened wedge-shaped portion, as shown in FIGS. 6 and 7, with a ('leading') nose section 17 of a curved profile to engage readily with the thread 23 on the neck-ring 60 and a ('trailing') tail section 18 configured so that, immediately after it passes the end of a thread 23, it can move into locking engagement therewith.

Figure 3:
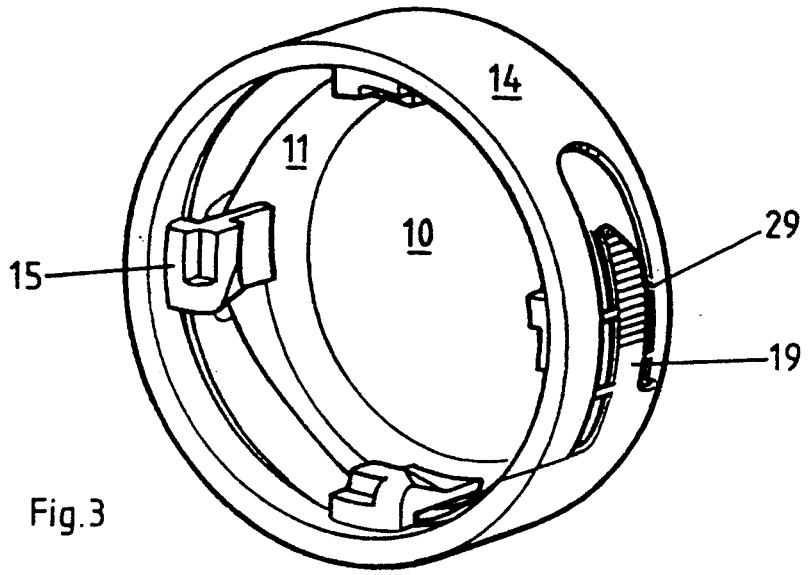
FIG. 3 shows, from the underside, the locking ring of FIG. 2 fitted upon the cap of FIG. 1.

When the locking member 40 is assembled to a closure 30, as shown in FIG. 3, the tongues 15 will lie in the recesses or grooves 16 in the threaded bead 12—thereby securing the locking member 40 to the closure 30 and inhibiting relative angular movement therebetween, while allowing limited axial movement (specifically, over a distance equal to one half of the neck-ring thread pitch).

Figure 8:
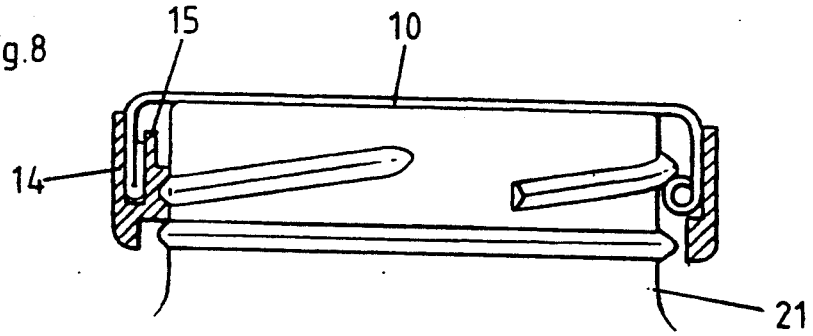
FIG. 8 shows the closure cap, locking ring and container neck assembly of FIG. 7 in a locked condition.
Figure 9:
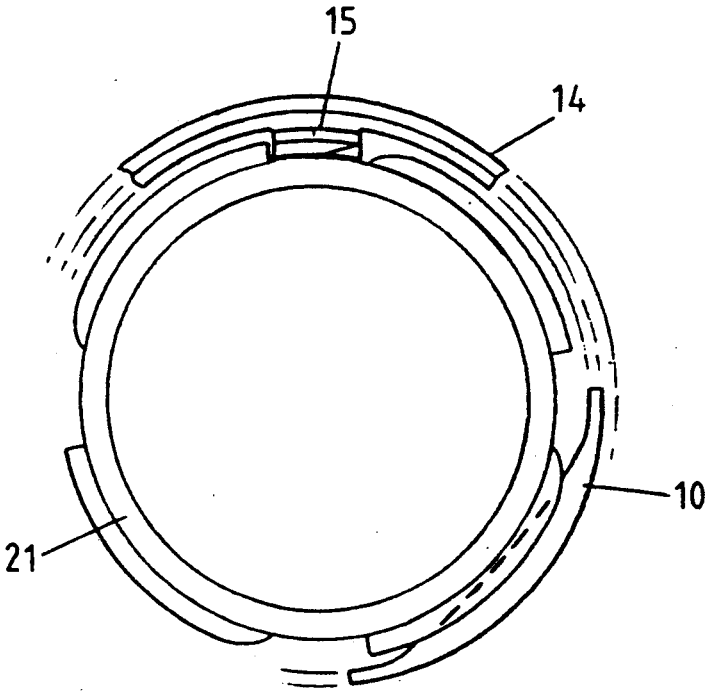
FIG. 9 shows a sectional view of the assembly of FIGS. 7 and 8.

As depicted in FIGS. 7, 8 and 9, the assembly is so arranged that, when the locking member 40 is in its lowest position relative to the closure 30, the thickened portions 17, 18 of the tongues 15 and the ribs between the grooves 13 in the bead 12 of the closure 30 are in the correct relative position to pass freely between the threads 23 on the neck-ring 60.

However, when the closure 30 has reached the position of sealing engagement (for example when the internal sealing washer engages the rim of the container neck), the locking member 40 has also moved to its upper position relative thereto—whereupon the thickened portions 17,18 of the tongues 15 will abut the ends of the threads 23.

The thickened portions 17,18 of the tongues 15 are then trapped between the bead 12 of the closure 30, the wall of the neck-ring 60 and the ends of the threads 23 and are both themselves thereby very effectively locked and obstruct or jam the threads 23.

As depicted in FIGS. 3 and 9, the closure 30 and locking member 40 assembly is applied to the neck-ring 60 in the general manner of a conventional closure.

The locking member 40 is carried by the closure 30 and, because it is angularly constrained therewith, rotates as the closure 30 itself rotates.

The thickened portions 17,18 of the tongues 15 are initially positioned below the bead 12 and hence they engage the threads 23 of the neck-ring 60, before the closure 30 itself, and in particular the grooves 13, reaches the threads 23.

As the thickened portions 17, 18 pass down between the threads 23, the closure 30 is brought into contact with the threads 23.

Normally the locking member 40 will at this stage be in its upper position relative to the closure 30, and hence the thickened portions of the tongues 15 will be out of alignment with the ribs in between the grooves 13 in the bead 12 of the closure 30.

However, the locking member 40 is fabricated from a material, such as synthetic plastics, with a degree of flexibility and resilience.

Hence, under the top pressure which is applied by a typical closure installation machine, the locking member 40 will flex sufficiently to allow the closure 30 to engage the threads 23 on the neck-ring 60—whereupon the locking member 40 will float downwards relative to the closure 30, into a position where it is in correct alignment.

As the closure 30 approaches the point of sealing engagement with the neck-ring 60, the thickened portions 17, 18 of the tongues 15 will be forced under the bottom end of the associated thread portions 23 and, thereafter will spring into respective locking positions, abutting against the ends of thread portions 23.

The annular ring 14 of the locking member 40 incorporates an integral tab 19, which can readily be lifted clear of the ring 14, by fracturing locating strands 29.

Thus, when pulled, the tab 19 will cause the ring 14 to fracture, (across a pre-formed weakening line), from a continuous loop into a single strip, whereupon the locking member 40 as a whole can be pulled clear away from the closure 30—taking with it each of the internal tongues 15 (which can be withdrawn from under the bead 12).

This effectively unjams the threads 23 and unlocks the hitherto locked threaded fastening of the closure 30, so that it can be unfastened—by unscrewing—and the container 50 opened.

The invention will work equally well with closures known in the closure art as 'lug caps'.

These are constructed in the same way as the grooved bead closure, except that the angled grooves are replaced by equally-spaced inwardly projecting lugs, which can pass under threads on the neck-ring to bring the closure into engagement therewith.

One advantage of a lug cap is that the lugs can be used to inhibit relative angular rotation and hence there is no need for recessed grooves in the bead.

One disadvantage of using a lug cap is that the radial gap between the bead and glass neck-ring is greater than that with a grooved bead closure, and hence it is more difficult for the wedge portion of the tongue, to achieve a locking condition between the closure and the neck-ring.

Similarly, the invention will work with closures where the threads are formed directly in the skirt, or where the bead is rolled outwardly.

Another advantage of the invention is the provision of an effective means of preventing the ingress of foreign matter into the space between the neck-ring and the skirt of the closure.

For added security, a warning message can be printed on the skirt of the closure, within the area covered by the outer member, so that the message is visible only when the outer member has been removed.

Figure 4:
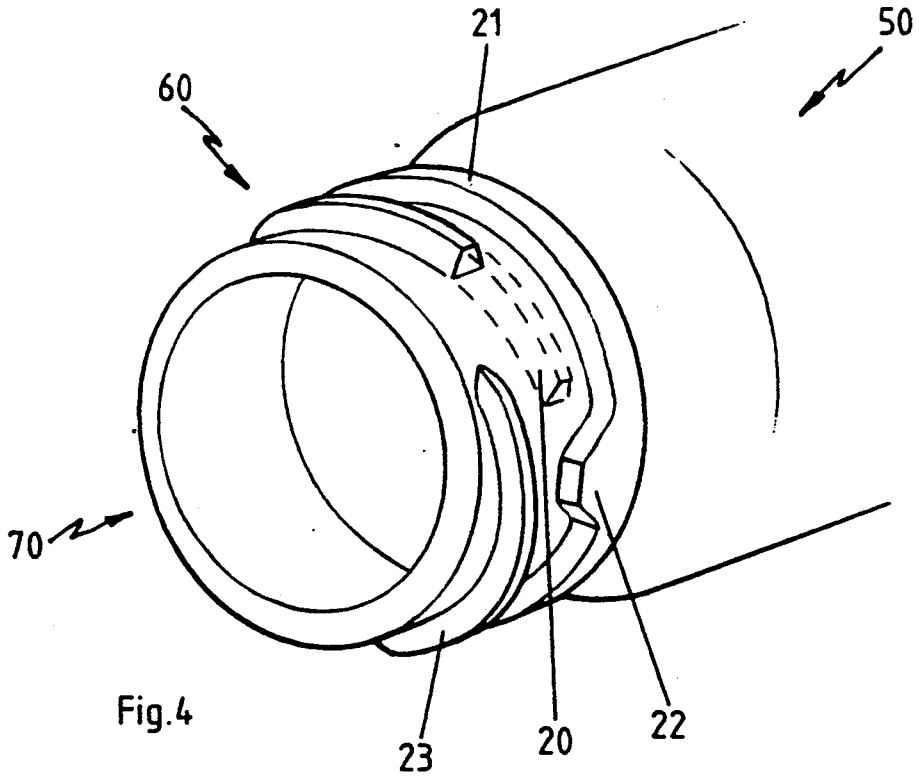
FIG. 4 shows the (threaded) neck ring of a container to which the assembled cap and locking ring of FIG. 3 is to be fitted.
Figure 5:
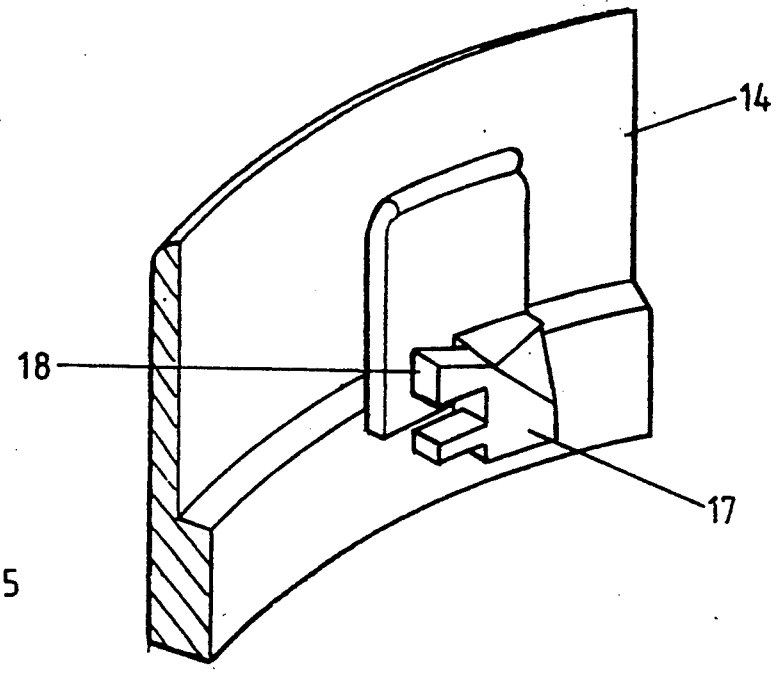
FIG. 5 shows a detail of a thread-running and locking tongue of the locking ring of FIG. 2.

The invention will function satisfactorily with a conventionally threaded neck-ring, but its performance can be enhanced by adding more elaborate features to the neck-ring as shown in FIG. 4.

Thus, removing the otherwise tapering or 'waisted' tail section 20 from the lower (or 'rear') end of one or more of the thread portions 23 on the neck-ring increases the locking action, by allowing the wedge 18 on the tongue 15 to abut directly against the full cross-section of the thread portions 23.

This also requires overlying thread portions, or a travel limiting continuous transfer ring 21, to form a co-operative restriction for the tongue wedge 18.

Indeed, the degree of overlap of the thread portions 23 may be varied to suit particular applications, but it is convenient with a multi-start thread to space the ends of successive thread portions, leaving a longitudinal channel through which the tongues 15 and the ribs between grooves 13 in the bead 12 may pass.

Incorporating a transfer ring 21 on the neck-ring 60 helps to secure the wedges 18 on the tongues 15 in a locking position, and profiling the upper surface of the transfer ring 21 to provide a localised abutment 22, which will encourage, by a co-operative displacement 'cam' action, the wedges 18 of the tongues 15 into a thread jamming or locking position, once they have passed the bottom ends of the lower thread portions 23.

When in a locked position, a closure 30 incorporating a locking member 40 and applied to a neck-ring 60 in the manner of the invention is completely restrained.

Specifically, it cannot be fastened any further, because of the resistance of the sealing surfaces—and it cannot be unfastened, because the tongues 15 integrated with its locking member 40 are themselves locked against the threads 23 of the neck-ring 60.

Hence it will readily be appreciated that a closure 30 according to the invention can securely seal a container 70—in that, once applied, it cannot be removed, without the locking member 40 being detached—thereby providing visible evidence that the closure 30 has been tampered with, or is vulnerable to such tampering.

I claim:

1. A lockable closure for a container having a neck portion formed with a plurality of radially outwardly projecting arcuate thread portions, comprising a rotary cap provided with internal threads configurated to mesh with said arcuate thread portions; a tamper indicative locking element engageable with said rotary cap for relative axial movement with said rotary cap and including first means for preventing relative rotation between said rotary cap and said locking element when axially engaged, said locking element further including at least one thread runner arranged to engage an arcuate thread portion, said closure cap and locking element each being threadedly engageable with the thread portions of the container, said at least one thread runner being resilient so that once said at least one thread runner has traversed an associated thread portion it is movable out of alignment with the associated thread portion to obstruct unthreading of said closure cap from the container, said thread runner being constrained by said cap and locking element, to thereby also prevent removal of said rotary cap once said internal thread thereof and said at least one thread runner have fully engaged the arcuate thread portions, said locking element further including breaking means for permanently breaking said locking element when locked to the container thereby releasing said at least one thread runner from locking engagement with the arcuate thread portion thereby permitting rotation and removal of said rotary cap from the container and providing a positive indication of tampering with the closure.

2. A closure as claimed in claim 1, wherein said locking element comprises a ring embracing a circumferential cap rim and said first means comprising a plurality of peripheral tongues mounted for passage internally of said cap rim and each carrying a thread runner.

3. A closure as claimed in claim 1, wherein said at least one thread runner is attached to said locking element by a flexible tongue to accommodate movement axially of the closure cap.

4. A closure as claimed in claim 1, wherein said locking element is free to move in its entirety axially of said rotary cap.

5. A closure as claimed in claim 1, wherein said at least one thread runner is resiliently deformable to fit within a container thread passage for rotary cap installation and reverts to a non-fitting profile when free of the container thread.

6. A closure as claimed in claim 1, wherein said at least one thread runner is biassed out of thread alignment by contacting a nose on an end of a container thread.

7. A closure as claimed in claim 1, wherein said at least one thread runner is biassed out of thread alignment by contacting a container abutment.

8. A closure as claimed in claim 1, wherein a leading edge of said at least one thread runner is tapered to facilitate passage over a container thread.

9. A closure as claimed in claim 1, wherein a trailing edge of said at least one thread runner is profiled to obstruct thread re-entry at an end of a container thread.

10. A closure as claimed in claim 1, in combination with a container with a threaded neck ring and an associated neck ring abutment beyond the neck ring thread with which said at least one closure thread runner reacts to effect thread misalignment and obstruct cap removal.

* * * * *